US007389551B2

(12) United States Patent
Stebner

(10) Patent No.: US 7,389,551 B2
(45) Date of Patent: Jun. 24, 2008

(54) LASH FOR A SPA

(76) Inventor: Dan Stebner, 1321 Burfield Drive, P.O. Box 1010, Sun Peaks, British Columbia (CA) V0E 5N0

( * ) Notice: Subject to any disclaimer, the term of this patent is extended or adjusted under 35 U.S.C. 154(b) by 494 days.

(21) Appl. No.: 11/182,745

(22) Filed: Jul. 18, 2005

(65) Prior Publication Data

US 2006/0010593 A1 Jan. 19, 2006

Related U.S. Application Data

(60) Provisional application No. 60/588,887, filed on Jul. 19, 2004.

(51) Int. Cl.
*E04H 4/06* (2006.01)

(52) U.S. Cl. ..... 4/503; 24/302; 70/164

(58) Field of Classification Search ..... 4/253, 4/496, 498, 503; 24/164, 167, 302; 70/15, 70/18, 164

See application file for complete search history.

(56) References Cited

U.S. PATENT DOCUMENTS 1,421,726 A * 7/1922 Saunders ..... 70/164 X
4,685,315 A 8/1987 Comolli
4,998,425 A * 3/1991 Hoogland ..... 70/164 X
4,999,980 A * 3/1991 McGowan ..... 24/302 X
5,373,590 A 12/1994 Svae et al.
5,901,418 A * 5/1999 Hopkins ..... 24/302
6,082,492 A 7/2000 Yerger
6,199,412 B1 3/2001 Kennedy
6,206,138 B1 3/2001 Yerger
6,510,717 B1 1/2003 Levi

* cited by examiner

*Primary Examiner*—Robert M. Fetsuga
(74) *Attorney, Agent, or Firm*—Antony C. Edwards

(57) ABSTRACT

A lash for a spa having a lid, wherein the lash includes an elongate flexible member having opposite first and second ends and at least two layers of webbing having a flexible metal cable interleaved between the layers of webbing. A releasably lockable latch is mounted or mountable on the first end of the flexible member for locking the first end of the flexible member to a corresponding first exterior wall of the spa. An anchor is mounted or mountable on the second end of the flexile member for irremovably anchoring the second end of the flexible member to a second exterior wall of the spa, opposite the first exterior wall of the spa.

7 Claims, 14 Drawing Sheets

LASH FOR A SPA

CROSS REFERENCE TO RELATED APPLICATION

This application claims priority from U.S. Provisional Patent Application No. 60/588,887 filed Jul. 19, 2004 entitled Spa Lash.

FIELD OF THE INVENTION

This invention relates to spas and hot tubs, and in particular the releasable securing of covers onto hot tubs or spas.

BACKGROUND OF THE INVENTION

A quick survey of spas and hot tubs will show that they typically are not well secured from unintentional use. Some spa covers have straps with quick release cargo snaps, or in some cases a simple plastic lock, which is easily defeated.

More than 4,400 people drowned in the United States in 1998. Drowning is the second leading cause of unintentional injury-related death for children ages 14 and under, and the leading cause of unintentional injury-related death among children ages 1 to 4. Most drownings occur in residential swimming pools and hot tubs. There has been significant publicity on securing swimming pools from unintentional use by children, but very little focus on securing hot tubs.

A 26-year survey of drownings in hot tubs, spas, and whirlpools in California 1960-85 suggests a person- and site-specific profile. The identified 74 deaths occurred mostly in White children, under two years of age, in Southern California, during the late afternoons, from May through August. From 1967 to 1985, the drowning rate increased tenfold. The deaths were associated with access to the water, lack of supervision, neuromotor handicaps, and entrapment by suction. Educational and environmental control efforts are required to reduce the incidence. Reference: Shinaberger C S, Anderson C L, Kraus J F. Department of Epidemiology, UCLA School of Public Health 90024-1772. PMID: 2327545 [PubMed—indexed for MEDLINE]

Hot tub covers are not adequate barriers to entry, and the straps provided with or for the covers are easily defeated. People have been known to use their neighbor's hot tubs without permission at ski hill condominiums, often cutting the conventional hot tub cover straps with a knife to gain access.

Applicant is aware of patents regarding devices which arc used to secure a variety of objects using reinforced webbing and locking mechanisms such as, U.S. Pat. No. 6,206,138 issued to Yerger on Mar. 27, 2001 teaches about a safety belt for climbing tree stands in which a chain is layered between two strips of webbing to form the belt.

U.S. Pat. No. 6,199,412 issued to Kennedy on Mar. 13, 2001 teaches about a lockable tie down strap that has one loose end that is secured in a key-operated locking member to prevent theft, and is preferably constructed of a tubular webbing with steel cables running through the body of the webbing to prevent cutting of the strap, and thereby more securely hold a load by the strap.

U.S. Pat. No. 4,930,324 issued to Meier on Jun. 5, 1990 teaches about a center-release buckle with a rotatable lock to secure a cover or belt, which lock is mounted in the buckle against a flexible flap in the buckle housing and is secured therein by mounting the housing on a base or frame.

SUMMARY OF THE INVENTION

In summary, the present invention may be characterized in one aspect as a lash for a spa having a lid, wherein the lash includes an elongate flexible member having opposite first and second ends and at least two layers of webbing having a flexible metal cable interleaved between the layers of webbing. A releasably lockable latch is mounted or mountable on the first end of the flexible member for locking the first end of the flexible member to a corresponding first exterior wall of the spa. An anchor is mounted or mountable on the second end of the flexile member for irremovably anchoring the second end of the flexible member to a second exterior wall of the spa, opposite the first exterior wall of the spa.

In a preferred embodiment, the anchor includes a channel having opposite first and second ends and opposite first and second side flanges rigidly mounted to, so as to extend substantially orthogonally from, a base portion of the channel. The base portion of the channel extends between the side flanges at the first end of the channel. An elongate rigid member is mounted or mountable over the base portion in mating engagement with the side flanges so as to define a web-receiving gap between the rigid member and the base portion. The web receiving gap is sized to snugly receive the second end of the flexible member through the gap. The second end of the channel is adapted for mounting by fasteners such as screws to the second exterior wall of the spa and for mounting the second end of the flexible member to the corresponding portion of the second exterior wall of the spa. Thus with the second end of the flexible member journalled through the gap and covering the base portion substantially the length of the channel from the gap to and across the second end of the channel. The flexible member and side flanges inhibit access to the fasteners.

That is, with the channel mounted to the second exterior wall of the spa with the second end of the channel above the first end of the channel, the flexible member may be wrapped upwardly around the rigid member so as to extend substantially vertically from the rigid member across, so as to cover, the base portion of the second end of the channel thereby occluding and inhibiting access to the base portion of the second end of the channel. Thus the fasteners fastening the second end of the channel and the second end of the flexible member to the second exterior wall of the spa are covered to inhibit access to the fasteners when the flexible member is tensioned over the spa and the lid. Advantageously, the flexible member is only long enough to extend from the latch to the anchor when the latch and the anchor are mounted to the first and second exterior walls of the spa respectively and when the flexible member is tensioned over the spa and the lid.

The side flanges of the channel may extend outwardly from the base portion so as to extend beyond edges of the flexible member when the flexible member is wrapped around the rigid member and covering across the base portion of the second end of the channel thus to further inhibit access to the fasteners. That is, it becomes more difficult to cut or pry the webbing away from the channel to get at the fasteners to undo them so as to remove the lash from the spa. A person trying to gain access to the spa would thus be more likely then to try to cut the webbing, and would run into the cable and thus would have to cut through the cable also. It is likely the person would be dissuaded and moves on to try a different spa.

In the preferred embodiment, the base portion is sized so that edges of the flexible member are closely adjacent and parallel to the side flanges of the channel when the flexible member is wrapped around the rigid member and is laid over so as to cover the base portion of the second end of the channel. The rigid member may be a shaft mounted through apertures in the side flanges, and the base portion may be substantially planar. The side flanges may further comprise a pair of rail protrusions extending inwardly of the channel, and along the length of at least the second end of the channel, so as to cover side-gaps between the edges of the flexible member, that is, the edges of the webbing, and the side flanges when the flexible member is wrapped around the rigid member and mounted into the channel between the side flanges and over the base portion of the second end of the channel.

In one embodiment a plate is mounted or mountable onto the base portion at the second end of the channel so as to sandwich the second end of the flexible member between the plate and the base portion when the channel is mounted to the second exterior wall of the spa.

The present invention serves to limit access to hot tubs by securing the hot tub or spa cover by means of a web lash that traps the cover on top of the hot tub or spa. The web lash may advantageously have an embedded cable within it and is secured on one end by a permanently fixed anchor and on the other end by a releasable locking mechanism The metal cable (for example stainless steel cable) embedded within the web lash inhibits the ability to defeat the lash by cutting it with a knife or scissors. Both the locking mechanism and the permanent lash anchor are attached to the hot tub or spa wall by fasteners such as screws, which are inaccessible when the lash is in use and locked.

DETAILED DESCRIPTION OF EMBODIMENTS OF THE INVENTION

Figure 8:
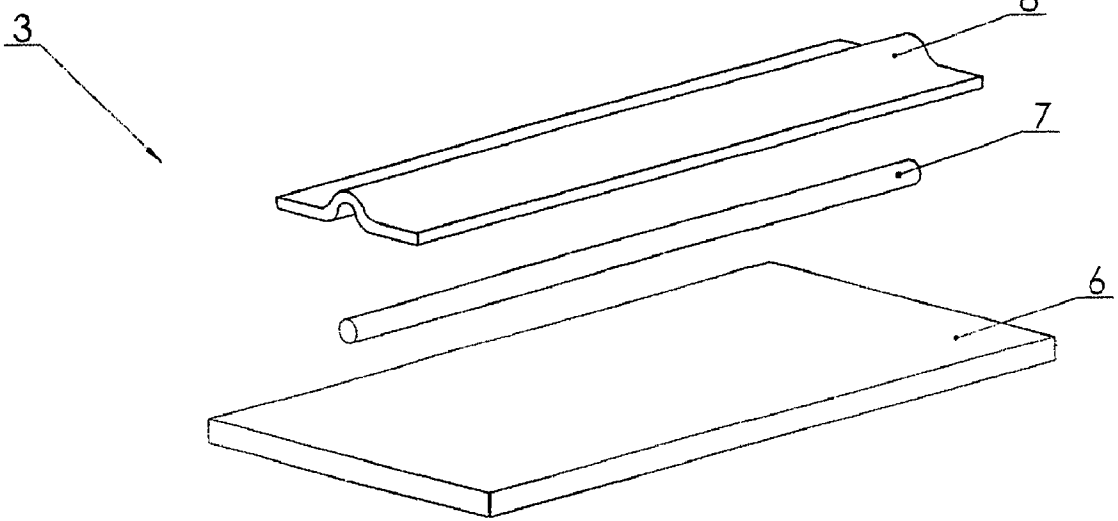
FIG. 8, is in perspective exploded view, the spa lash laminated webbing with the cable core.

The present invention is a lash that secures a cover onto a hot tub or spa (collectively referred to as a spa). The lash is made of webbing, for example two lengths of nylon webbing stitched together so as to sandwich a stainless steel cable between the lengths of webbing as seen in FIG. 8. One end of the lash is permanently anchored to the spa by a wrap-around anchor mount. The webbing is passed over the spa and cover and mated onto a locking mechanism mounted to the other side of the spa, on the opposite side from the anchor mount. Access to the spa is achieved by unlocking the locking mechanism, lifting the lash off the cover, and removing the cover from the spa.

Figure 1:
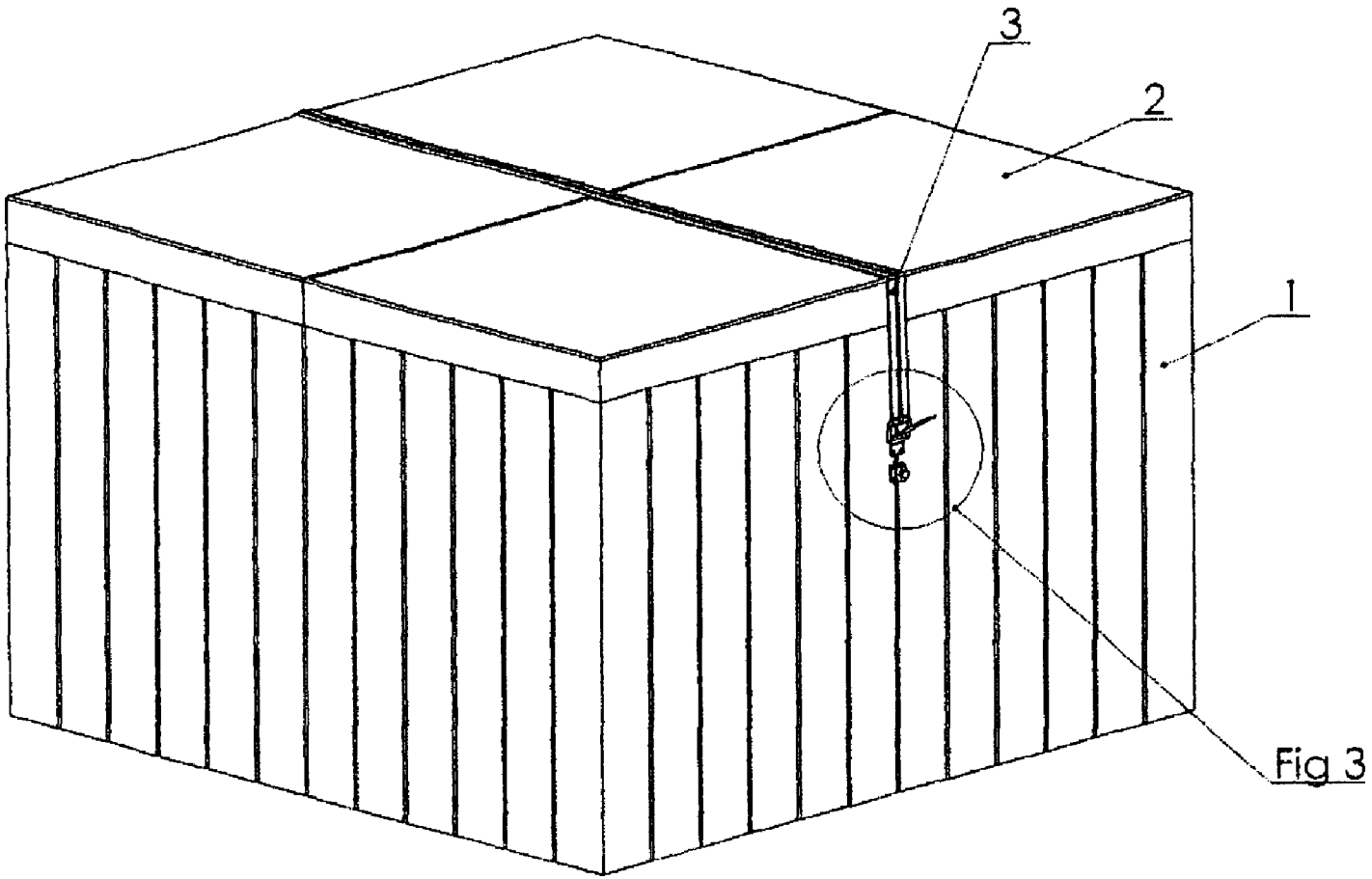
FIG. 1 is, in perspective view, a spa or hot tub with a cover on and an embodiment of the present invention being placed.
Figure 2:
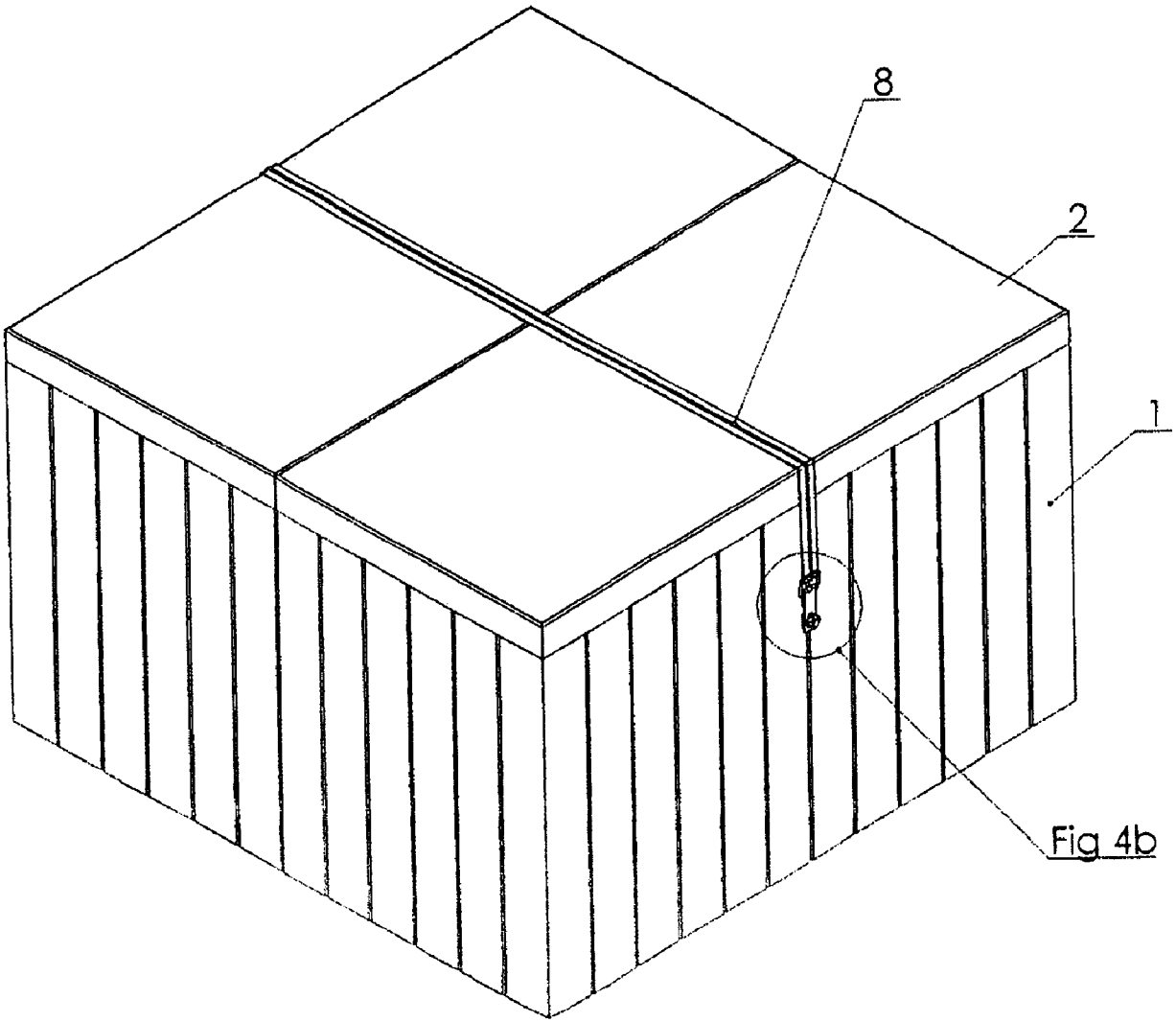
FIG. 2 is in perspective view, a spa or hot tub with a cover on and secured by an embodiment of the present invention.
Figure 3:
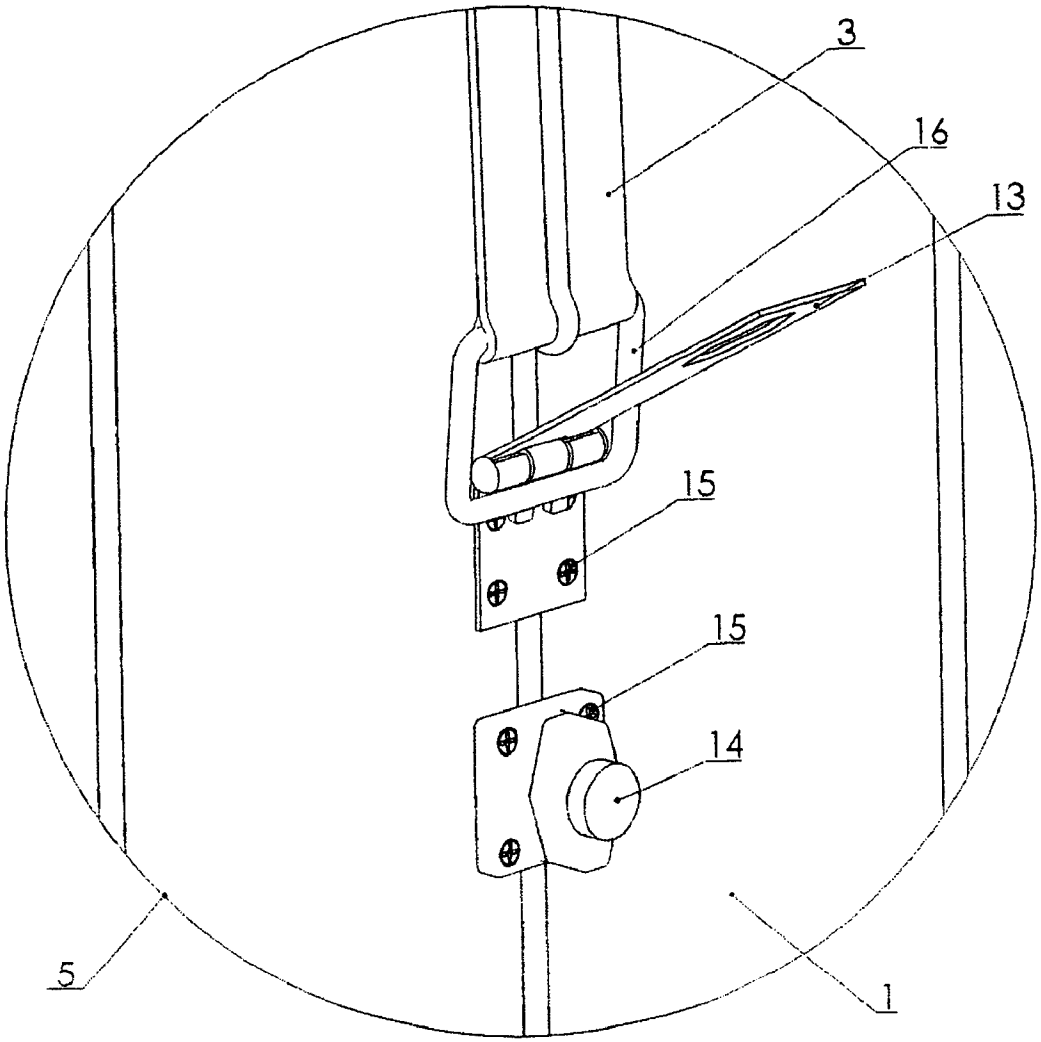
FIG. 3, is in perspective view, a close up of the locking mechanism of an embodiment of the present invention with the D-ring of the spa lash being placed.
Figure 4A:
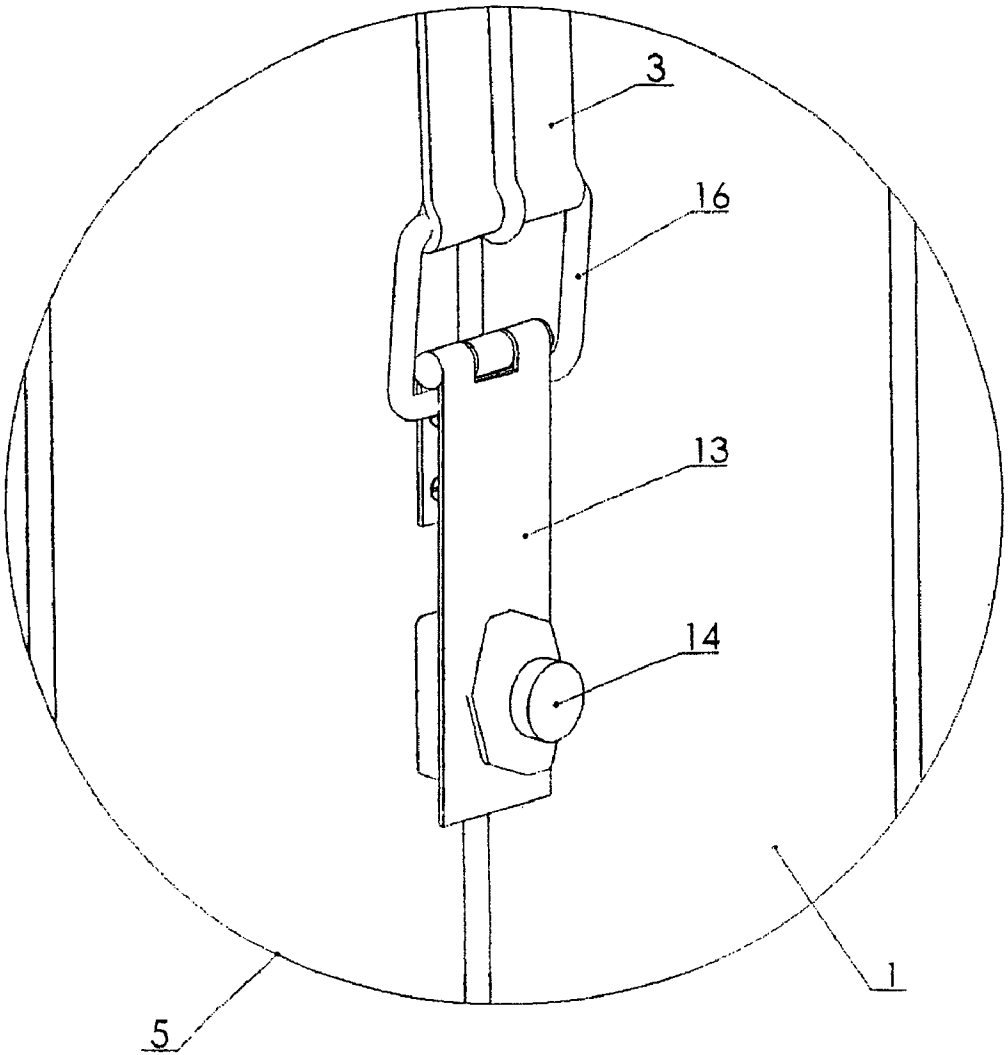
FIG. 4*a* is, in enlarged perspective view, the locking hasp mechanism of FIG. 1 with the hasp closed but with the lock unlocked.
Figure 4B:
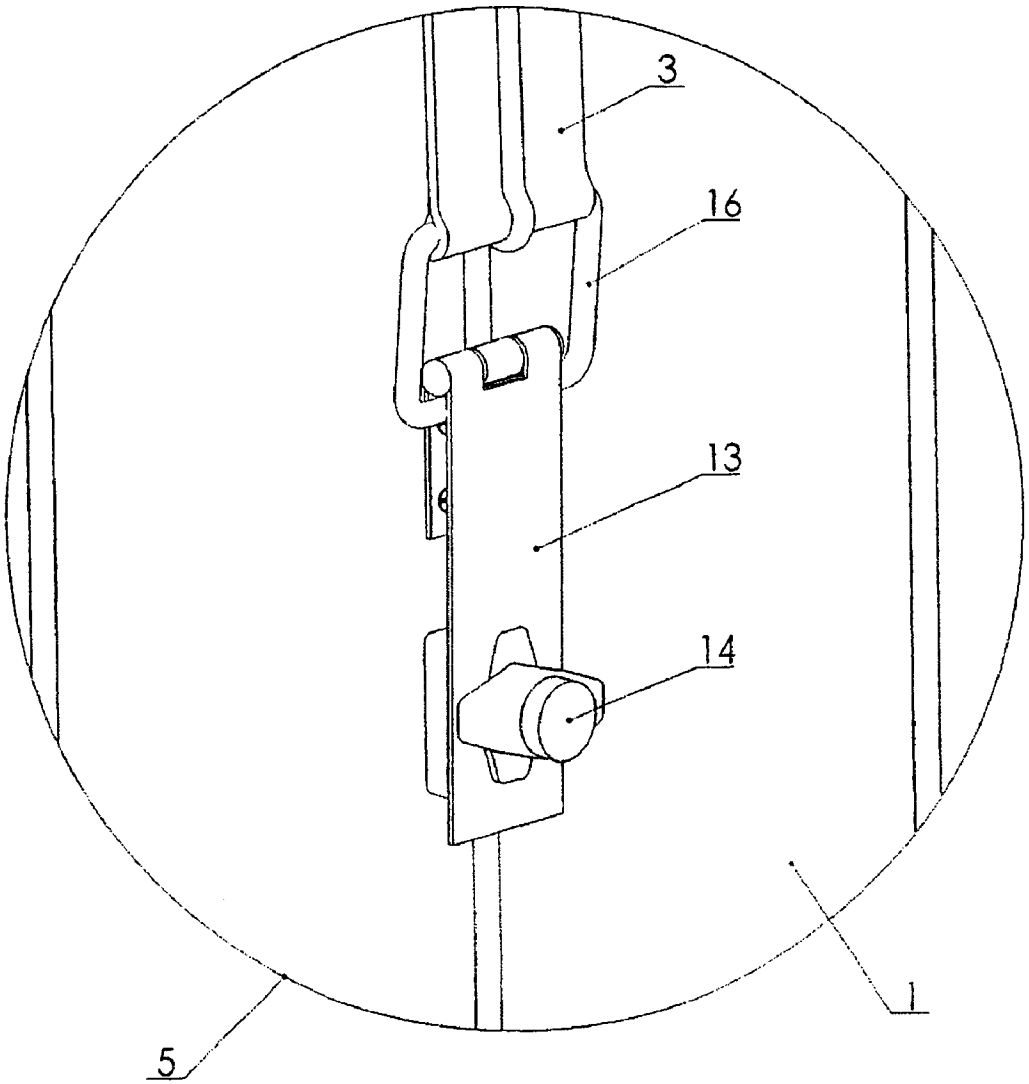
FIG. 4*b* is the view of FIG. 4*a* with the lock in the locked position over the hasp.
Figure 9:
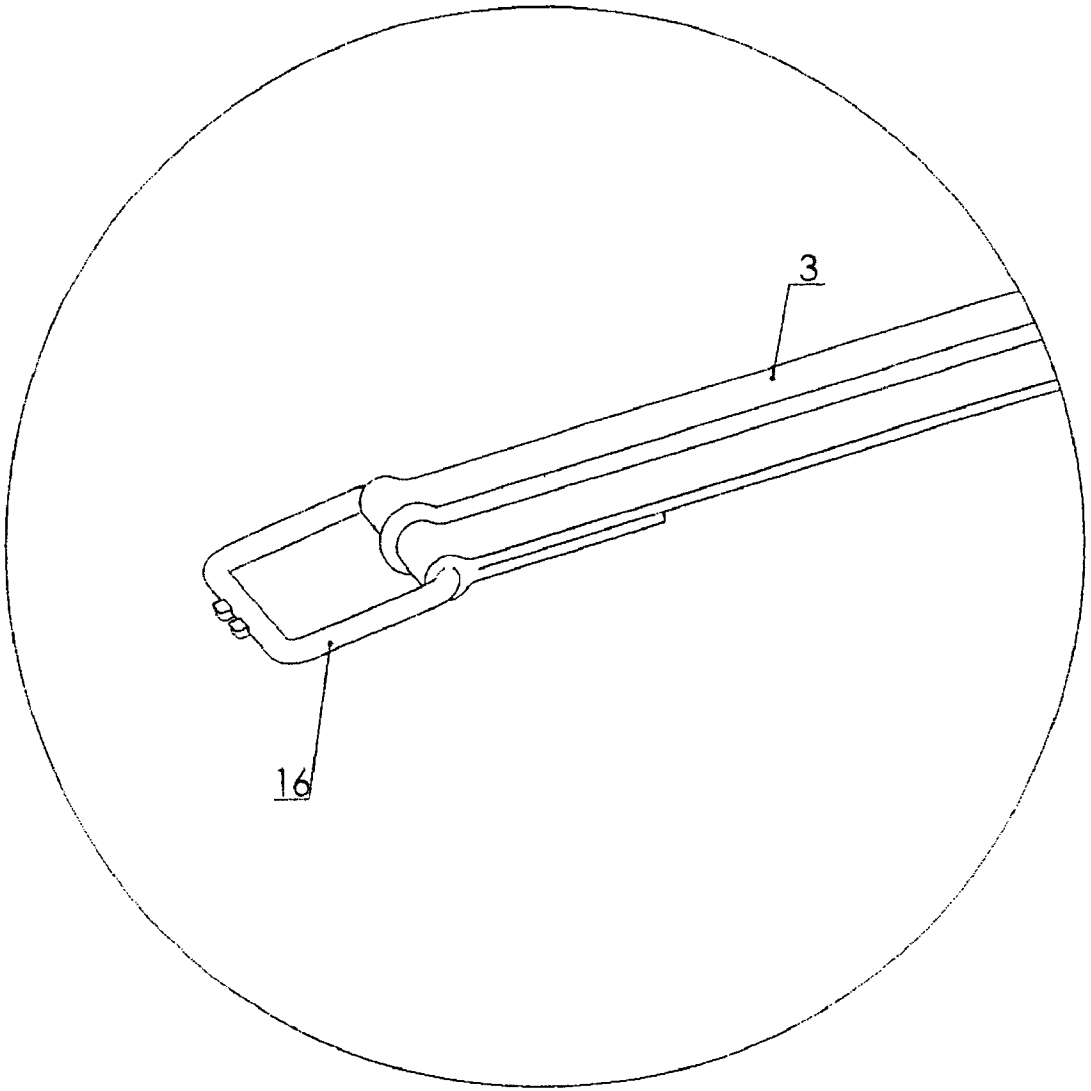
FIG. 9, is in perspective close up view the unsecured end of the spa lash showing the D-Ring attachment.

The accompanying figures illustrate a preferred embodiment of the present invention wherein similar characters of reference denote corresponding parts in each view. Thus spa 1 has a cover 2 secured by lash 3. Anchor 4 mounts one end of lash 3 to the spa. Lock or releasably lockable latch 5 mounts the other end of lash 3 to the spa. FIGS. 1 and 3 show lock 5 open. FIGS. 2 and 4*b* show lock 5 closed and locked. FIG. 4*a* shows lock 5 closed but not locked. As best seen in FIG. 3, lock 5 includes a hasp 13 and a rotatable member 14 mounted to the walls of the spa by screws 15. A D-ring 16 is sewn or riveted onto one end of webbing 3 as seen in FIG. 9. D-ring 16 fits over hasp 13 when the hasp is open. Hasp 13 is then closed about its binge and the hasp secured and locked closed by passing rotatable member 14 through an opening in the end of the hasp and by rotating the rotatable member to lock the end of the hasp against the side of the spa. Member 14 is locked in place by a conventional key actuated lock set (not shown).

Figure 5A:
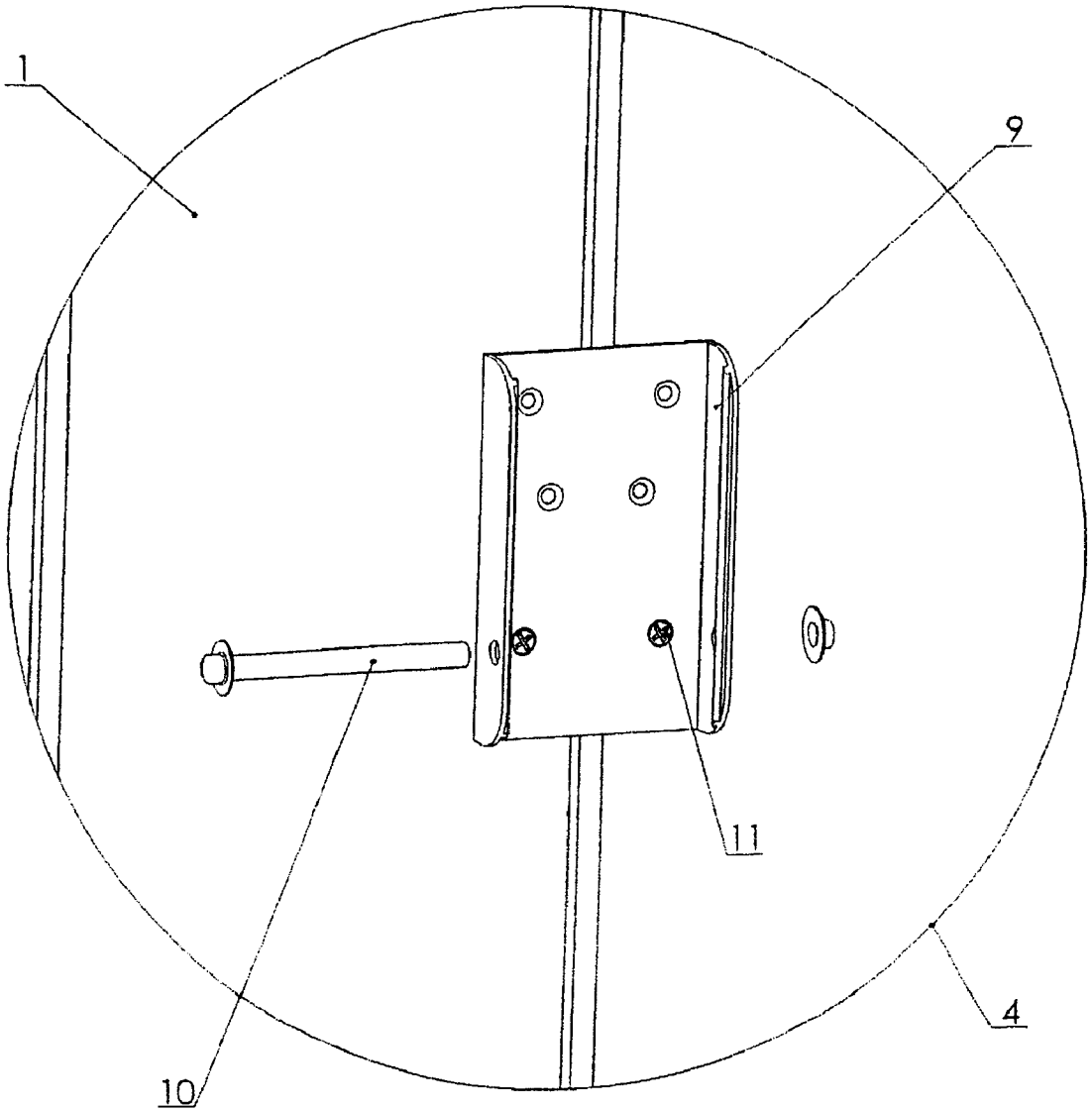
FIG. 5*a* is, in perspective view, the anchor for the anchor end of the webbing lash partially secured to the wall of a spa.
Figure 5B:
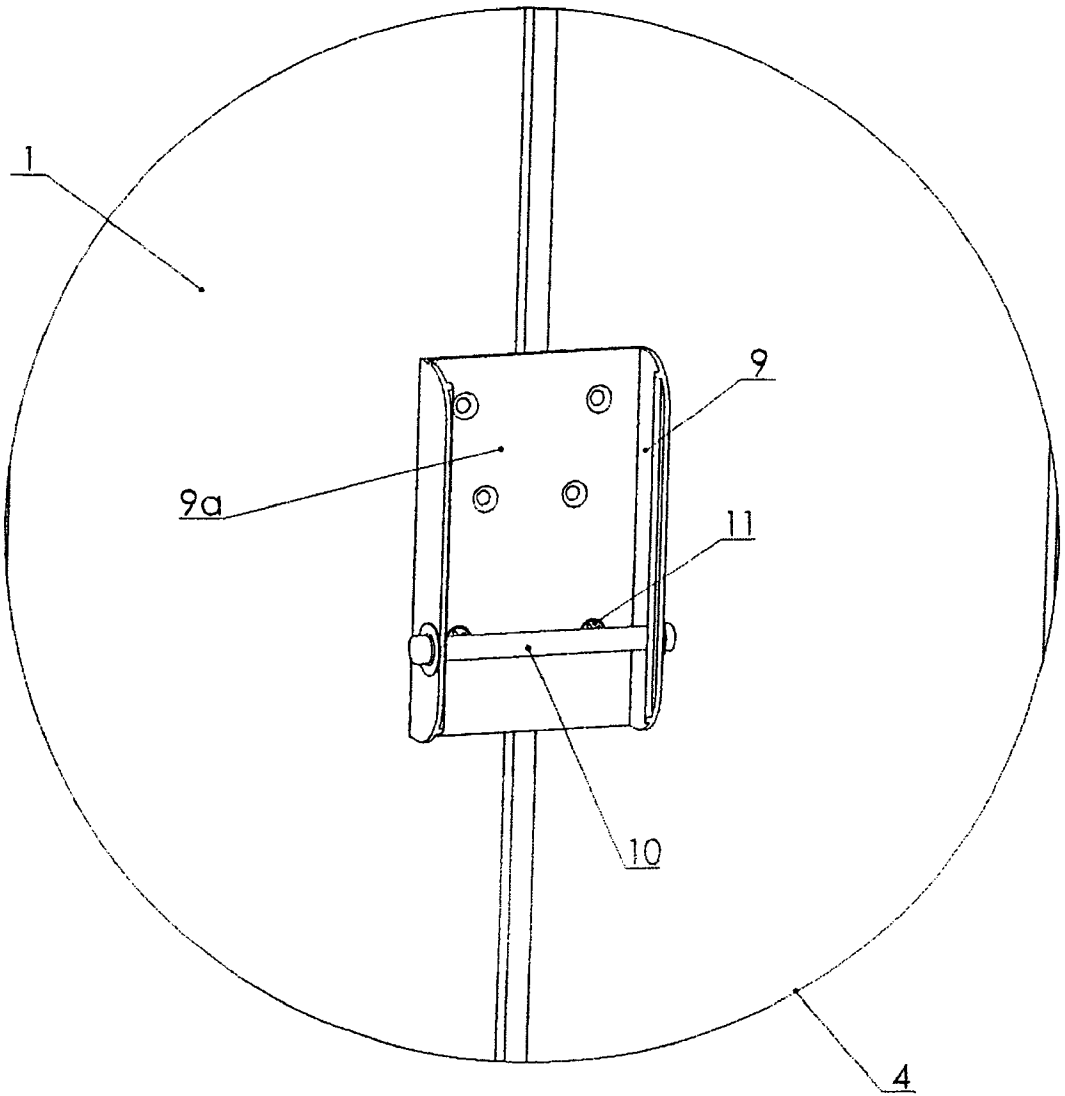
FIG. 5*b* is the view of FIG. 5*a* with the anchor pin installed.
Figure 5C:
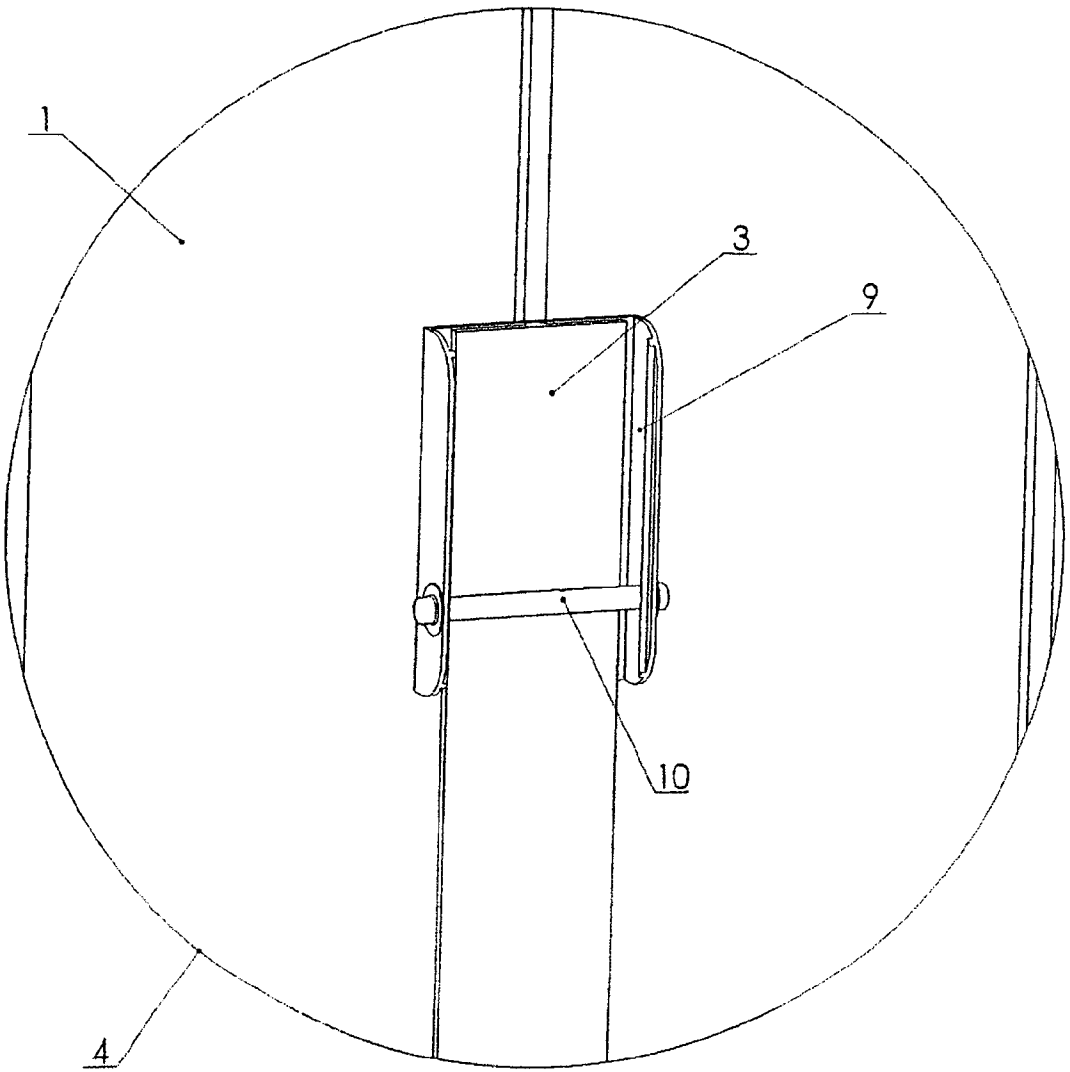
FIG. 5*c* is the view of FIG. 5*b* with one end of the webbing lash mounted in the channel of the anchor underneath the anchor pin.

The permanently anchored end of lash may be attached to the spa as shown in FIGS. 5*a*-5*e*, and FIG. 6. Channel 9 is mounted to the spa by anchor screws 11, after which anchor pin or elongate rigid member or shaft 10 is installed through holes on either side of channel 9, and capped as shown in FIG. 5*b*. Pin 10 impedes removal of the screws 11 located under the pin. The end of cable reinforced webbing 3 is then slid along channel 9 under anchor pin 10 as shown in FIG. 5*c*.

Figure 5D:
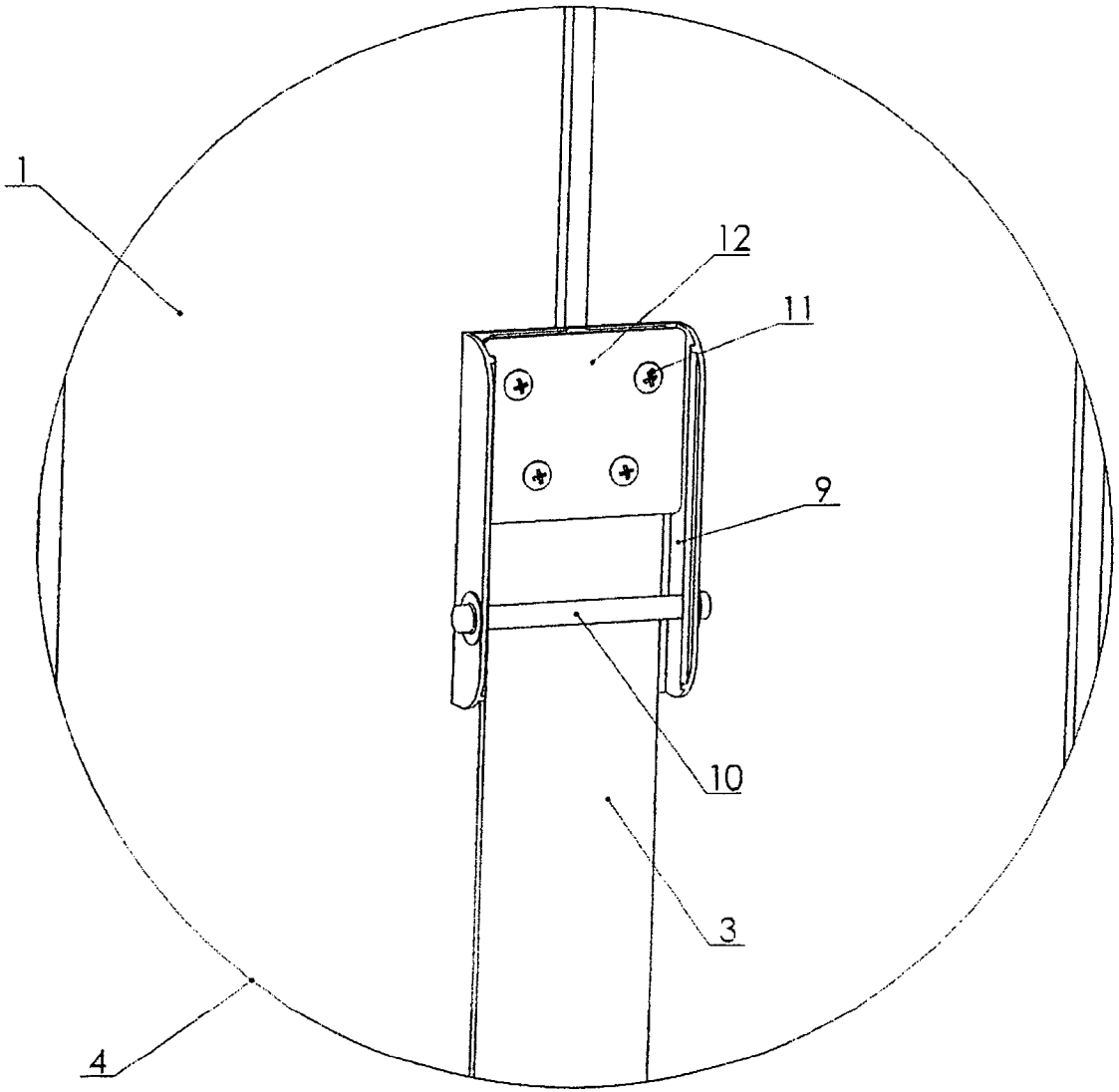
FIG. 5*d* is the view of FIG. 5*c* with an anchor plate mounted over the end of the webbing lash mounted in the anchor channel.
Figure 5E:
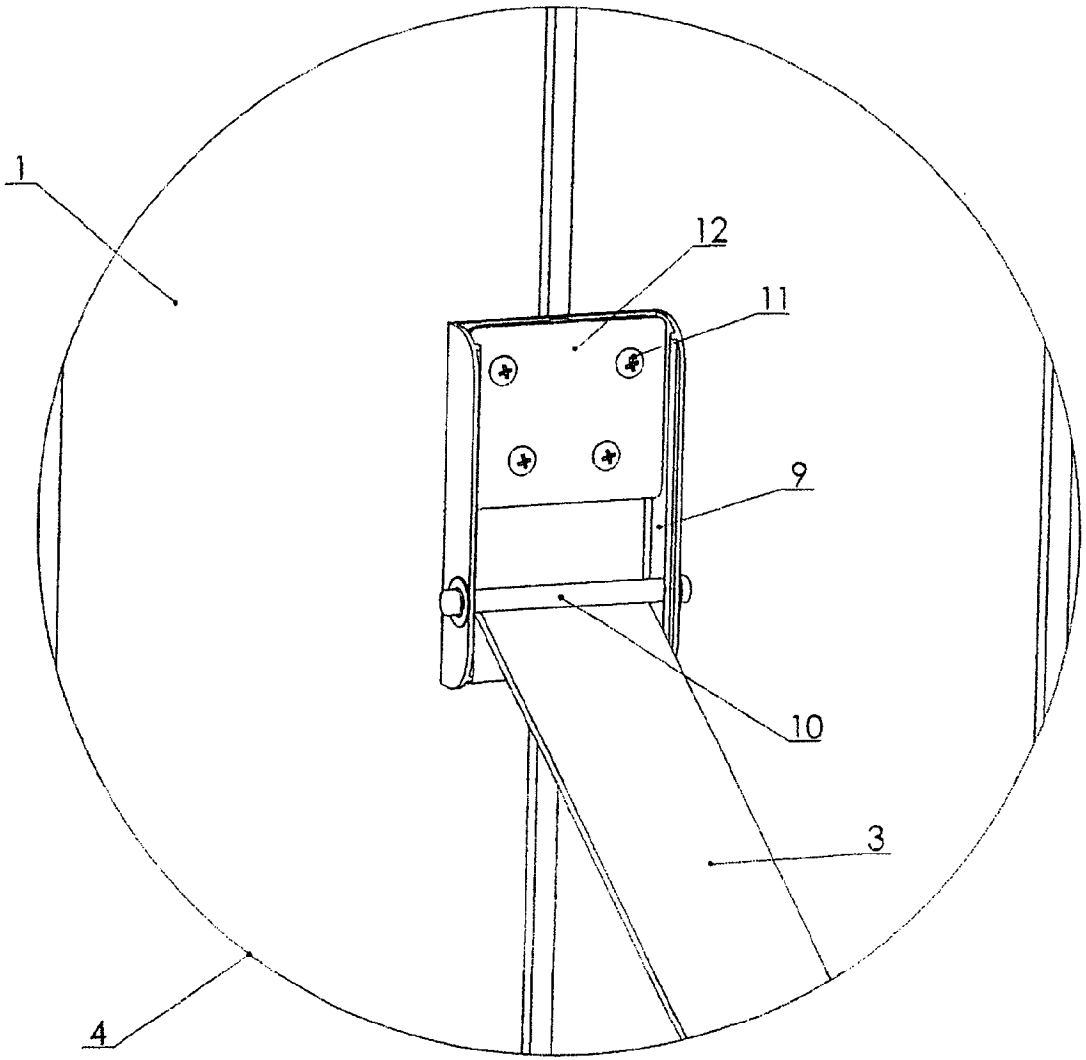
FIG. 5*e* is the view of FIG. 5*d* with the webbing lash being rotated upwardly about the anchor pin.
Figure 6:
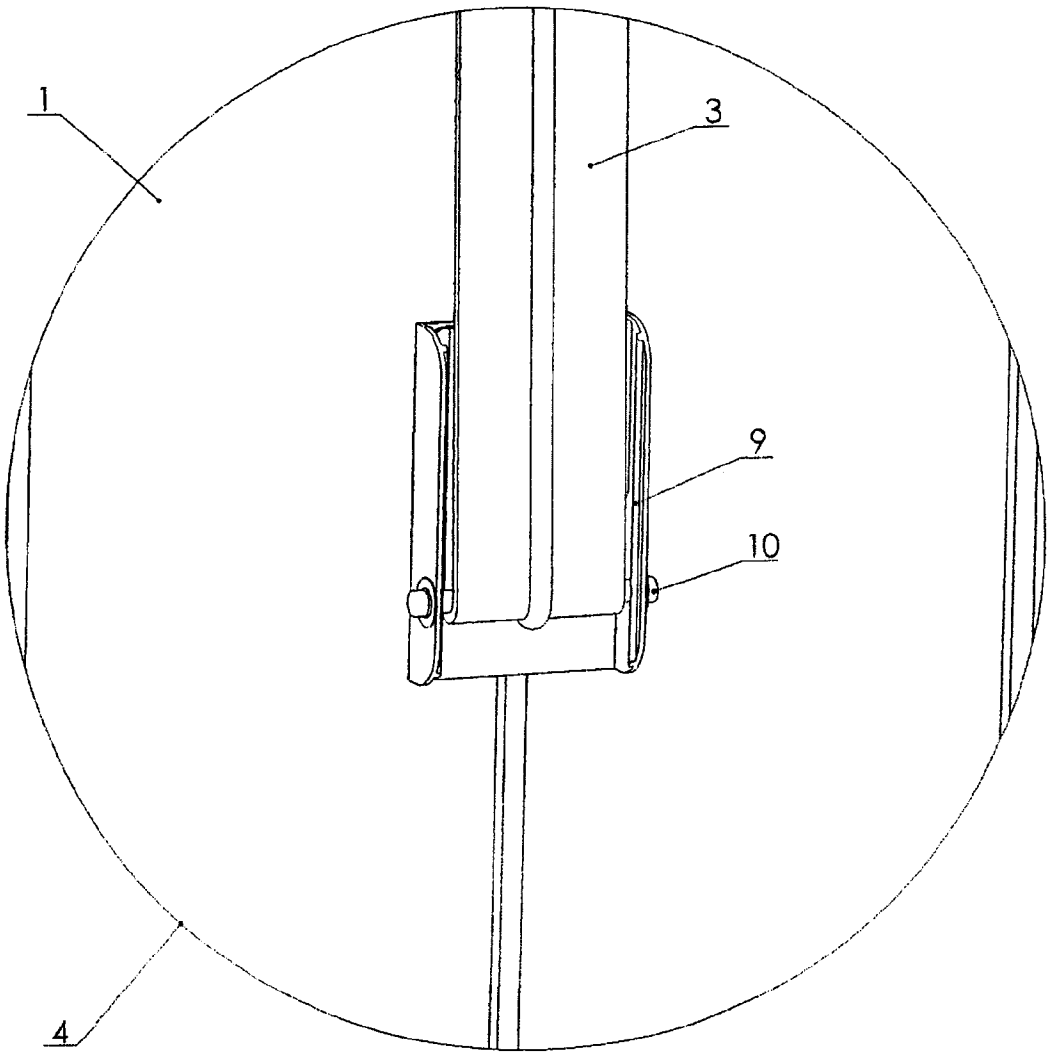
FIG. 6, is in perspective view, a close up of an embodiment of the present invention with the anchor after installation.
Figure 6A:
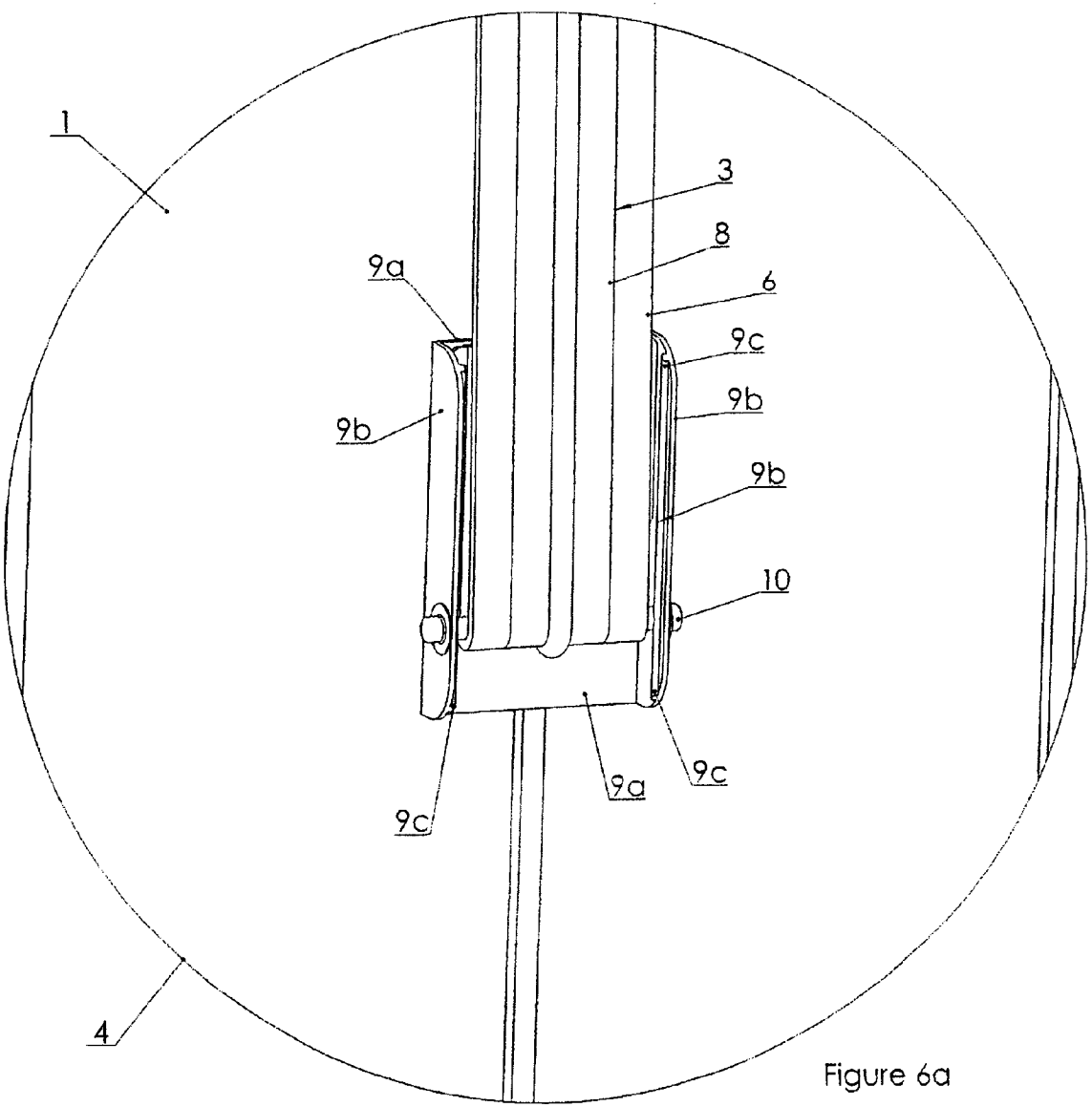
FIG. 6*a* is an enlarged view of FIG. 6.

Anchor plate 12 is then positioned over that end of the webbing in channel 9 and fastened to the wall of the spa by anchor screws 11 passing through apertures in plate 12, through webbing 3 and through apertures in channel 9 into the wall of the spa as shown in FIG. 5*d*. The free length of the cable reinforced webbing 3 is then lifted up so that it wraps around anchor pin 10 as seen in FIG. 5*e* and laid vertically between the side walls of channel 9 as seen in FIG. 6 so as to cover anchor plate 12. This further inhibits access to anchor screws 11.

Figure 7:
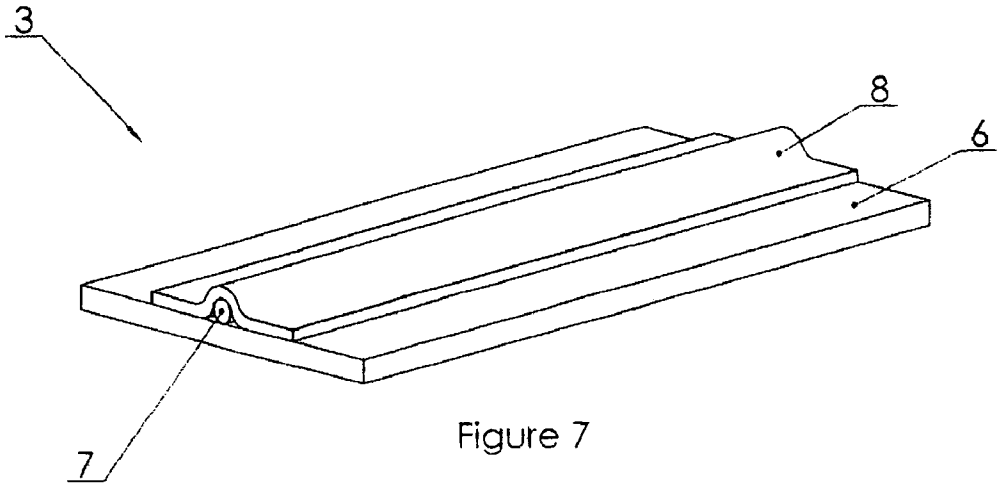
FIG. 7, is in perspective view, the spa lash laminated webbing with the cable core.

In one embodiment, as seen in FIGS. 7 and 8, cable reinforced web 3 is constructed of two strips of braided nylon webbing 6 and 8. The narrower web 8 is mounted over the wider web 6 with cable 7 mounted in between web 6 and web 8. The upper web 8 is stitched to the lower web 6 thereby holding cable 7. In this manner the cable reinforced web provides additional protection against malicious tampering or cutting of the web to gain access to the hot tub or spa.

Channel 9 includes a substantially planar base portion 9*a* extending between oppositely disposed parallel sidewalls or side flanges 9*b*. The sidewalls are spaced apart a distance substantially equal to, or slightly greater than the width of webbing layer 6. Pin 10 is spaced from base portion 9*a* so as to create an elongate gap between the pin and base portion. The gap is sized so that the thickness of web 3, that is, the combined thickness of webbing layers 6 and 8 and the diameter of cable 7, may be slid under pin 10 and along channel 9.

The side edges of webbing layer 6 are thus elevated from base portion 9*a* by the diameter of cable 7 and the thickness of webbing layer 8. This might permit entry by a prying tool between web 3 and base portion 9*a*. Hence, sidewalls 9*b* protrude orthogonally outwardly from base portion 9*a* so as to extend beyond, that is outwardly from, the side edges of webbing layer 6 to inhibit access by a prying or cutting tool into channel 9. Further, ribs or rail protrusions 9*c* running along the inside of walls 9*b*, act to cover any gaps between the side edges of webbing layer 6 and sidewalls 9*b*, so as to make entry into channel 9 more difficult and to make it more difficult to pry a side edge of webbing layer 6 upwardly or outwardly from the channel, all of which makes access to the screws more difficult.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A lash for a spa having a lid comprising:

an elongate flexible member having opposite first and second ends and including at least two layers of webbing having a cable interleaved between said at least two layers of webbing, a releasably lockable latch mountable on said first end of said flexible member for locking said first end to a corresponding first exterior wall of the spa.

an anchor mountable on said second end of said flexile member for irremovably anchoring said second end to a second exterior wall of the spa opposite the first exterior wall of the spa, wherein said anchor includes a channel having opposite first and second ends, said channel having opposite first and second side flanges rigidly mounted to, so as to extend substantially orthogonally from, a base portion and extending between said side flanges at said first end of said channel, an elongate rigid member mountable over said base portion in mating engagement with said side flanges so as to define a web-receiving gap between said rigid member and said base portion sized to snugly receive said second end of said flexible member therethrough, wherein said second end of said channel is adapted for mounting by fasteners to the second exterior wall of the spa and for mounting said second end of said flexible member to the corresponding portion of the second exterior wall of the spa so that, with said second end of said flexible member journalled through said gap and covering said base portion substantially the length of said channel from said gap to and across said second end of said channel, and with said second end of said channel mounted to the second exterior wall of the spa with said second end of said channel above said first end of said channel so that said flexible member may be wrapped upwardly around said rigid member so as to extend substantially vertically from said rigid member across so as to cover said base portion of said second end of said channel thereby occluding and inhibiting access to said base portion of said second end of said channel.

whereby the fasteners fastening said second end of said channel and said second end of said flexible member to the second exterior wall of the spa are covered to inhibit access to the fasteners when the flexible member is tensioned over the spa and the lid, said flexible member only long enough to extend from said latch to said anchor when said latch and said anchor are mounted to the first and second exterior walls of the spa respectively and when said flexible member is tensioned over the spa and the lid.

2. The lash of claim 1 wherein said side flanges of said channel extend outwardly from said base portion so as to extend beyond edges of said flexible member when wrapped around said rigid member and covering across said base portion of said second end of said channel thus to further inhibit access to the fasteners.

3. The lash of claim 1 wherein said base portion is sized so that edges of said flexible member closely adjacent and parallel to said side flanges of said channel when said flexible member is wrapped around said rigid member and covering across said base portion of said second end of said channel.

4. The lash of claim 3 wherein said rigid member is a shaft mounted through apertures in said side flanges.

5. The lash of claim 4 wherein said base portion is substantially planar.

6. The lash of claim 3 wherein said side flanges further comprise a pair of rail protrusions extending inwardly of said channel, and along the length of at least said second end of said channel, so as to cover side-gaps between said edges of said flexible member and said side flanges when said flexible member is wrapped around said rigid member and mounted into said channel between said side flanges and over said base portion of said second end of said channel.

7. The lash of claim 1 further comprising a plate mountable onto said base portion at said second end of said channel so as to sandwich said second end of said flexible member between said plate and said base portion when said channel is mounted to the second exterior wall of the spa.

* * * * *